United States Patent [19]

Seiler et al.

[11] Patent Number: 5,014,069

[45] Date of Patent: May 7, 1991

[54] PHOTOCONDUCTIVE ANTENNA MODULATOR

[75] Inventors: Milton R. Seiler, Worthington; Kenneth J. Walcott, Dayton, both of Ohio

[73] Assignee: The United States of America as Represented by the Secretary of the Air Force, Washington, D.C.

[21] Appl. No.: 407,837

[22] Filed: Sep. 15, 1989

[51] Int. Cl.[5] ..... H01Q 13/00

[52] U.S. Cl. ..... 343/785; 343/786

[58] Field of Search ..... 343/785, 786, 762, 754, 343/783; 333/81 R

[56] References Cited

U.S. PATENT DOCUMENTS

| | | | |
|---|---|---|---|
| 3,222,601 | 12/1965 | Sartorio | 325/130 |
| 4,150,382 | 4/1979 | King | 343/754 |
| 4,575,727 | 3/1986 | Stern et al. | 343/768 |

*Primary Examiner*—Rolf Hille

*Assistant Examiner*—Hoanganh Le

*Attorney, Agent, or Firm*—William G. Auton; Donald J. Singer

[57] ABSTRACT

A photoconductive antenna modulator which optically modulates a radio frequency carrier signal from a dielectric waveguide antenna is disclosed. A photoconductor film is placed in proximity with the dielectric waveguide antenna such that the radio frequency carrier signal from the antenna must be conducted through the film when it is radiated into space. The carrier is then optically modulated by variably illuminating the photoconductor film with light which has wavelengths near the photoconductor film's spectral region of photoconductor sensitivity, which decreases the photoconductor film's transparency to the radio frequency carrier signal. By varying the strength of the illumination on the photoconductor film, one is able to optically modulate the radio frequency carrier signal propagated through the photoconductor.

6 Claims, 1 Drawing Sheet

PHOTOCONDUCTIVE ANTENNA MODULATOR

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to radar systems, and more specifically to a light-activated modulator which modulates radar waves at microwave frequencies.

Modulators are used in microwave or millimeter-wave radars to turn off or turn on power sources or to amplitude modulate a signal. The conventional modulator may be a diode or tube in a waveguide. Such modulators receive a carrier frequency signal, from a microwave source which they modulate by an electronic modulating signal, from a waveform generator, to produce a modulated signal which is radiated out to detect objects in the radar's field of view.

The task of producing a light-activated modulator for radar systems, is alleviated to some extent by the systems disclosed in the following U.S. Patents, the disclosures of which are specifically incorporated herein by reference:

U.S. Pat. No. 3,222,601 issued to Sartorio;

U.S. Pat. No. 4,150,3S2 issued to King; and

U S Pat. No. 4,575,727 issued to Stern et al.

The Sartorio reference discloses an antenna beam scanner in which an antenna beam is scanned by selectively illuminating a layer of photoconductive material which is placed over the aperture of an antenna. The purpose of the Sartorio system is to vary the direction and/or shape of the radio frequency (RF) beam.

The King reference discloses an antenna system which provides electronically controlled scanning of the radiation pattern. This system uses an array of elements which are electrically connected to a set of phase shifters which electronically steer the radar beam.

The Stern et al reference discloses a millimeter-wave electronic scan phase array antenna. This system also steers its radar beam electronically by shifting the individual phases of RF signals across an array of transmitting radar elements.

While the systems disclosed in the above-cited references are instructive, most prior art systems appear to modulate their radar waves by either switching on and off their power sources, or by other electronic conventional methods such as amplitude modulation. In view of the foregoing discussion, it is apparent that there remains the need to provide a system capable of optically modulating radio frequency signals for both transmission and reception. The present invention is intended to satisfy that need.

SUMMARY OF THE INVENTION

The present invention is a photoconductive antenna modulator system. This system includes a light-activated mOdulator to optically modulate radar waves at microwave frequencies.

One embodiment of the present invention includes; a microwave source, a dielectric waveguide antenna, a film of photoconductive material, and a light source. The microwave source provides a microwave frequency carrier signal which is optically modulated as follows.

In the present invention the film of photoconductive material (such as cadmium sulfide or silicon) is placed adjacent to a dielectric waveguide antenna. Illumination of the photoconductor by light or infrared energy corresponding to the spectral region of the photoconductor sensitivity will increase the photoconductor's conductivity and make the film less transparent to the microwave radiation. The stronger the illumination, the greater the depth of modulation of the antenna radiation. The photoconductor film thereby modulates the output of the dielectric waveguide antenna with the variations in the illumination.

In another embodiment of the invention, the microwave frequency carrier signal is modulated within a photoconductive layer placed between a polystyrene waveguide (at 94 GHZ) and a metallic periodic base which is a periodic structure made of brass having a layer thereon of silicon and cadmium sulfide with groves spaced 2.2 mm apart. A source of illumination is provided for modulating the photoconductive layer's transparency in the manner described above. This enables the photoconductive layer to modulate the carrier signal which passes through it with the optical modulating signal from the illumination source.

The effect of the conductivity of a photoconductive element on RF energy has been recognized. However, the optical modulation of microwave frequency carrier signals has not been recognized in the prior art. More specifically, the use of an optical modulating signal on a microwave carrier to produce modulated radar waveforms has not been recognized in the prior art. Accordingly, it is an object of the present invention to provide a photoconductive antenna modulator.

It is another object of the present invention to optically modulate radar waves at microwave frequencies.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a light activated modulator, which modulates radar waves at microwave frequencies. In the present invention, the microwave frequencies of the carrier signal range between 300 Mc and 300 Gc. This will include the L, S, C, X and K bands used in radar systems, but not the VHF radar frequencies (which have wavelengths between 1-10 m).

Figure 1:
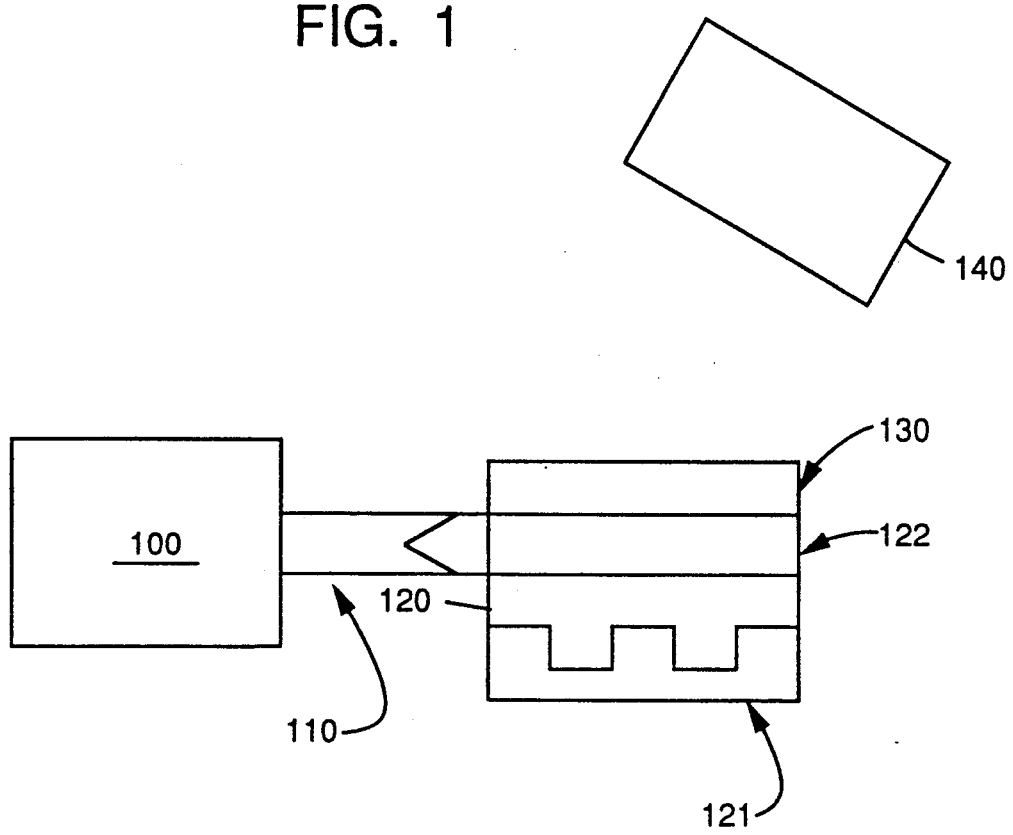
FIGS. 1 and 2 are schematics which each depict an embodiment of the present invention.

The reader's attention is now directed toward FIG. 1 which is a schematic of an embodiment of the present invention. The system of FIG. 1 includes: a microwave source 100, a metallic waveguide 110, a dielectric waveguide antenna 120, a photoconductive layer 130, and an illumination source 140.

The microwave source 100 is a conventional source of microwave frequency carrier signals, which are commonly used in radar systems. As mentioned above, microwave frequencies range between 300 MHz and 300

GHz, but the more commonly used radar frequencies are listed below in Table 1.

TABLE 1

| Radar Frequency Band | Frequency |
|---|---|
| UHF | 300-1,000 MHz |
| L | 1,000-2,000 MHz |
| S | 2,000-4,000 MHz |
| C | 4,000-8,000 MHz |
| X | 8,000-12,500 MHz |
| $K_u$ | 12.5-18 GHz |
| K | 18-26.5 GHz |
| $K_a$ | 26.5-40 GHz |
| Millimeter | >40 GHz |

It is believed that the microwave source 100 of FIG. 1 need not be described in further detail. For more information, the reader is advised to consult the text entitled "Introduction to Radar Systems" by Merrill I. Skolnik, published by the McGraw-Hill Book Company in 1962, the disclosure of which is incorporated herein by reference.

The metallic waveguide 110 is similar to the microwave source 100 in that these components are known in the art. In the present invention, the metallic waveguide 110 conducts the RF carrier signal into the optical modulator of the present invention.

The optical modulator of the present invention includes: an illumination source 140, a photoconductive layer 130, and a dielectric antenna element 120. The dielectric antenna element transmits RF energy received from the metallic waveguide into space using a metallic periodic structure 121 and a dielectric waveguide cap 122. The dielectric antenna element 120 is conventional in the art, and is described in greater detail in the above-cited Stern et al reference.

Most dielectric waveguide antenna elements include a metallization layer. In the system of FIG. 1 a metallic periodic structure 121 is used in the manner described in the above-cited Stern et al reference. The periodic slots act as radiating elements while beam scanning can be electrically affected by varying the bias voltage across the Schottky barrier barriers in the dielectric waveguide cap 122. The present invention differs from prior art systems in that the dielectric waveguide antenna can be modulated optically rather than electronically. In the system of FIG. 1, electronic modulation is not precluded, because this element can be modulated both electronically (as described in the Stern et al reference) as well as optically.

As mentioned above, conventional waveguide antenna elements are usually modulated electronically by phase adjustments and by turning the antenna's power source on and off so that the RF energy is modulated before it actually reaches the antenna elements. In the present invention, the photoconductive layer 130 is a film of photoconductive material (such as cadmium sulfide or silicon) which is placed adjacent to the dielectric antenna element 120. Illumination of the photoconductor by light or infrared energy, corresponding to the spectral region of photoconductor sensitivity, will increase the photoconductor's conductivity and make the film less transparent to the microwave or millimeter-wave radiation. The stronger the illumination, the greater the depth of modulation of the antenna radiation.

In FIG. 1, an experiment was conducted using a polystyrene waveguide antenna at 94 GHz. The periodic structure is made of brass, with grooves spaced 2.2 mm. Photoconductor films of silicon and cadmium sulfide are placed near the dielectric antenna element 120. Other suitable photoconductors would also work. The photoconductor may be placed on the radiation side of the waveguide as in FIG. 1 or between the waveguide and the periodic structure as in FIG. 2.

Observed modulation ratios (ratio of peak antenna power to minimum antenna power) were about 3:1. Further optimization of the photoconductors can be determined empirically to determine the preferred thickness of the film and the achievable light-to-dark resistivity ratios. Currently used thickness were 0.0496" of silicon and 0.08" of Cd S.

The desired features of this invention are the overall simplicity and the ability to directly modulate the antenna pattern rather than the microwave/millimeter-wave source. Patterns of photoconductor can be deposited on the waveguide to achieve light-activated sidelobe and beamwidth control to form other embodiments of the present invention. The illumination source 140 should emit light or infrared energy which corresponds to the spectral region of photoconductor sensitivity. In doing this the illumination source is able to produce an optical modulating signal which will increase the photoconductor's conductivity, which will in turn make the film less transparent to the microwave radiation emitted by the dielectric waveguide antenna. Therefore the operating characteristics of the illumination source 140 is dependent upon two factors: the desired modulation characteristics which are to be transposed onto the carrier signal, and the particular photoconductor selected. This is discussed in greater detail below.

A photoconductor exhibits a change in conductance (resistance) when radiant energy (photons) is incident upon it. The radiant energy increases the conductance by producing more carriers in the detector. A photoconductor is operated in a mode in which an applied electric field produces a current that is modulated by additional carriers produced by photon excitation, that is, radiation quanta are absorbed and free (photogenerated) charge carriers are generated in the semiconductor. These additional carriers cause an increase in the conductivity of the semiconductor. This phenomenon is called photoconduction.

Photoconductors are made from semiconductor materials. The general characteristics of semiconductor photoconductors that make them different from thermal detectors are:

1. Time constant.
2. Spectral selectivity.
3. High sensitivity.

Photodetection time responses lie between those of fast photomultiplier tubes (10 nsec) and thermal detectors (50 msec), and typically are in the microsecond range under normal room-temperature background environments. The spectral responsivity is determined by the energy gap. Only photons that have energies greater than the energy gap will be absorbed and cause current to flow.

The photon energy required to cause an electron transition across the energy gap ($E_g$) is $hv=E_g$, where h=Planck's constant and v=optical radiation frequency. The radiation induced transitions form the basis for photoconductivity.

Table 2 lists some examples of intrinsic semiconductors that are photoconductors with their associated energy gaps.

TABLE 2

| | $E_g$ (eV) |
|---|---|
| PbSe | 0.23 |
| PbS | 0.42 |
| Ge | 0.67 |
| Si | 1.12 |
| CdSe | 1.8 |
| CdS | 2.4 |

Free carriers are produced only when the radiation photons have sufficient energy to cause the electrons to cross the energy gap. Therefore, there is a limit on the wavelength response to which a given semiconductor will detect radiation.

The minimum optical frequency, v, photon that will produce a free electron from covalent bond is $v = E_g/h$. If one rewrites this limiting condition in terms of wavelength, $$\lambda_c = \frac{1.24}{Eg} \text{ microns or micrometers} \quad (1)$$

where $\lambda_c$ = maximum wavelength of radiation to produce an electronic transition, $E_g$ = energy gap in eV.

The illumination source should emit light with wavelengths near $\lambda_c$ as calculated from equation 1 for the particular energy gaps characteristic of the photoconductors listed in Table 2.

In use, the optical modulator can selectively attenuate the RF energy of the microwave carrier as follows. As observed in the above-cited Sartorio reference, when light is conducted to a photoconductor (through which radar RF energy is propagating) it selectively varies the conductivity of the photoconductive material. The dark conductivity of the photoconductor has negligible effect on RF energy propagating from the antenna. However, when the conductivity of the photoconductor is increased by exposing it to the proper radiation, the Rf energy from the antenna is attenuated. Thus, the illumination source 140 attenuates the radar signal when it shines on the photoconductive layer 130 with light which has a wavelength given by equation 1. When the illumination source ceases to shine on the photoconductor, the photoconductor has negligible effect on the RF energy propagating from the dielectric antenna element 120. In this manner, by turning on and off, the illuminating source produces an optical modulating signal which modulates the microwave carrier signal as it propagates through the photoconductor layer 130.

Figure 2:
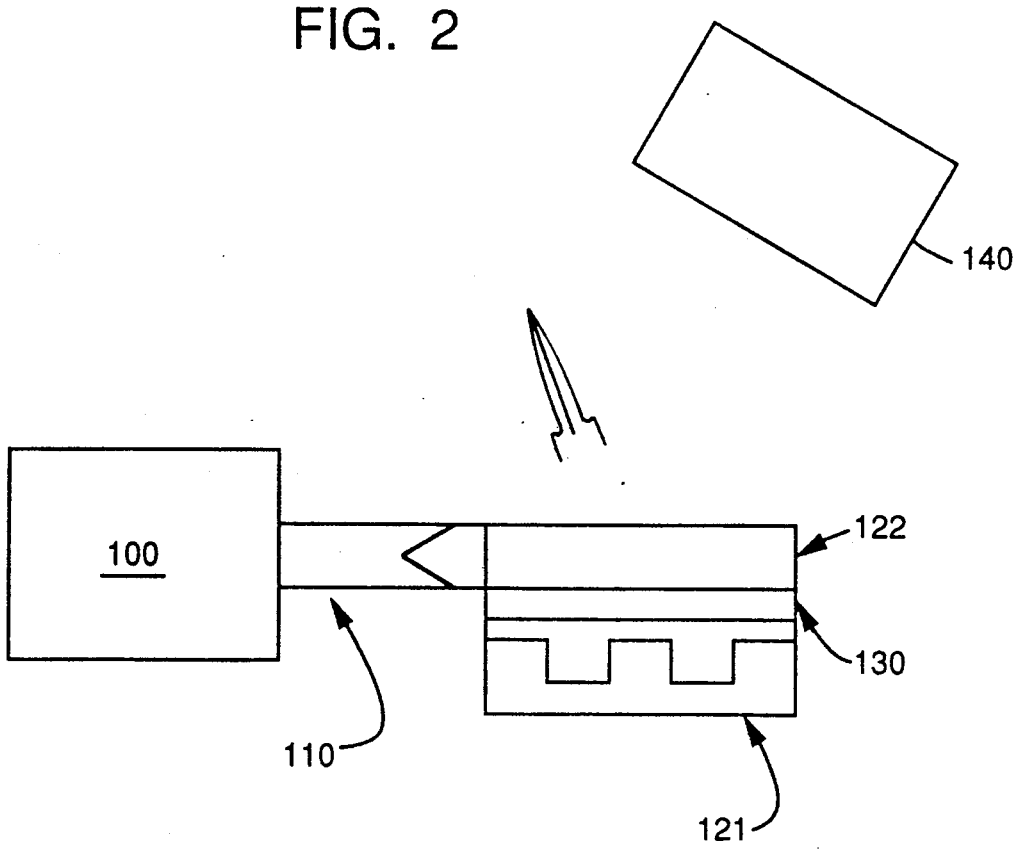

FIG. 2 is another embodiment of the present invention. In the system of FIG. 2, the photoconductor film 130 is deposited between the metallic periodic structure 121 and the dielectric waveguide cap 122 of the antenna element 120. The principle of operation of the system of FIG. 2 differs slightly from that of FIG. 1, for the reasons discussed below.

In the system of FIG. 1, the photoconductor film acts almost as an optically controlled shutter with a variable transparency which varies the output of the antenna element 120. More specifically, the output of the antenna element 120 is a constant transmission of the microwave carrier, but the output is selectively blocked and modulated by the variable transparency of the photoconductor film. This selective blocking and modulation allows the user to transmit the microwave carrier in variable waveforms including pulses, chirped pulses, and bursts of pulses.

In the system of FIG. 2, the photoconductor film 130 is deposited between the metallic periodic structure 121 and the dielectric waveguide cap 122. In this position the photoconductor film varies its transparency to selectively obstruct the interaction between the dielectric waveguide cap 122 and the metallic periodic structure 121. The selective obstruction causes the antenna element 120 to emit the microwave Rf carrier with optically controllable modulation for the reasons discussed below.

The photoconductor film 130 of FIG. 2 has the same characteristics as discussed above in the description of FIG. 1. The conductivity of the photoconductor film 130 of RF energy is varied optically by the variations in the illumination from the illumination source 140. In the system of FIG. 2 the placement of the photoconductor film 130 causes it to selectively obstruct the interaction between the dielectric waveguide cap 122 and the metallic periodic structure as its conductivity is varied optically. This results in a modulation of the RF energy produced by the dielectric waveguide antenna element 120.

The system of FIG. 2 is another embodiment of the present invention. FIG. 2 is a schematic which depicts a light-activated modulator for use with a radar system which has a radar transmitter, including a microwave source which emits a carrier radio frequency signal, and an antenna with at least one antenna element 120 which transmits radar waveforms.

All elements in FIG. 2 are identical with those elements of FIG. 1 with like reference numerals. In the system of FIG. 2, the photoconductor film is placed within the antenna element between the dielectric waveguide cap 122, and the metallic periodic base structure 121. In this position, the photoconductor film 130 can variably obstruct the interaction between the metallic periodic structure 121 and the dielectric waveguide cap 122 by manifesting variable transparency to said carrier radio frequency signal between the metallic periodic structure 121 and the dielectric waveguide cap. As the illumination from the light source increases in intensity, the photoconductor reduces its transparency to the carrier radio frequency above, thus the system of FIG. 2 acts as a light-activated modulator which optically controls the amplitude of the carrier emitted from the antenna element 120.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A light-activated modulator for use with a radar system, said radar system having a radar transmitter which emits a carrier radio frequency signal, a dielectric waveguide antenna which transmits said carrier radio frequency signal, and a metallic waveguide which conducts said carrier radio frequency signal from said radar transmitter to said dielectric waveguide antenna, said light-activated modulator comprising:

an illumination source which emits an optical modulating signal; and a photoconductor layer which is placed adjacent to said dielectric waveguide antenna, and which receives said optical modulating signal from said illumination source, wherein said photoconductor layer comprises Si, and wherein said light-activated modulator emits said optical modulating signal with variable intensities such that said optical modulating signal has a wavelength of about $\lambda_c$ where $\lambda_c$ is given by:

$$\lambda c = \frac{1.24}{E_g} \text{ microns,}$$

where: $E_g$ is an energy gap which is measured in electron volts for Si and equals about 1.12 electron volts, said optical modulating signal thereby decreasing said photoconductor layer's transparency to said carrier radio frequency signal as said optical modulating signal increases in intensity, said optical modulating signal allowing said photoconductor layer's transparency to increase as said optical modulating signal decreases in intensity, said light-activated modulator thereby optically modulating said carrier radio frequency signal.

2. A light-activated modulator for use with a radar system, said radar system having a radar transmitter which emits a carrier radio frequency signal, a dielectric waveguide antenna which transmits said carrier radio frequency signal, and a metallic waveguide which conducts said carrier radio frequency signal from said radar transmitter to said dielectric waveguide antenna, said light-activated modulator comprising:

an illumination source which emits an optical modulating signal; and a photoconductor layer which is placed adjacent to said dielectric waveguide antenna, and which receives said optical modulating signal from said illumination source, wherein said photoconductor layer comprises Cds, and wherein said light-activated modulator emits said optical modulating signal with variable intensities such that said optical modulating signal has a wavelength of about λc where λc is given by:

$$c = \frac{1.24}{E_g} \text{ microns,}$$

where: $E_g$ is an energy gap with is measured in electron volts for Si and equals about 2.4 electron volts, said optical modulating signal thereby decreasing said photoconductor layer's transparency to said carrier radio frequency signal as said optical modulating signal increases in intensity, said optical modulating signal allowing said photoconductor layer's transparency to increase as said optical modulating signal decreases in intensity, said light-activated modulator thereby optically modulating said carrier radio frequency signal.

3. A light-activated modulator, for use with a radar system, said radar system having a radar transmitter which emits a carrier radio frequency signal, a dielectric waveguide antenna which transmits said carrier radio frequency signal, and a metallic a waveguide which conducts said carrier radio frequency signal from said radar transmitter to said dielectric waveguide antenna, said light-activated modulator comprising:

an illumination source which emits an optical modulating signal; and a photoconductor layer which is placed adjacent to said dielectric waveguide antenna, and which receives said optical modulating signal from said illumination source, wherein said photoconductor layer comprises PbSe, and wherein said light-activated modulator emits said optical modulating signal with variable intensities such that said optical modulating signal has a wavelength of about λc where λc is given by:

$$\lambda c = \frac{1.24}{E_g} \text{ microns,}$$

where: $E_g$ is an energy gap which is measured in electron volts for PbSe and equals about 0.23 electron volts, said optical modulating signal thereby decreasing said photoconductor layer's transparency to said carrier radio frequency signal as said optical modulating signal increases in intensity, said optical modulating signal allowing said photoconductor layer's transparency to increase as said optical modulating signal decreases in intensity, said light-activated modulator thereby optically modulating said carrier radio frequency signal.

4. A light-activated modulator, for use with a radar system, said radar having a radar transmitter which emits a carrier radio frequency signal, a dielectric waveguide antenna which transmits said carrier radio frequency signal, and a metallic waveguide which conducts said carrier radio frequency signal from said radar transmitter to said dielectric waveguide antenna, said light-activated modulator comprising:

an illumination source which emits an optical modulating signal; and a photoconductor layer which is placed adjacent to said dielectric waveguide antenna, and which receives said optical modulating signal from said illumination source, wherein said photoconductor layer comprises PbS, and wherein said light-activated modulator emits said optical modulating signal with variable intensities such that said optical modulating signal has a wavelength of about $\lambda_c$ where $\lambda_c$ is given by:

$$\lambda_c = \frac{1.24}{E_g} \text{ microns,}$$

where: $E_g$ is an energy gap which is measured in electron volts for PbS and equals about 0.42 electron volts, said optical modulating signal thereby decreasing said photoconductor layer's transparency to said carrier radio frequency signal as said optical modulating signal increases in intensity, said optical modulating signal allowing said photoconductor layer's transparency to increase as said optical modulating signal decreases in intensity, said light-activated modulator thereby optically modulating said carrier radio frequency signal.

5. A light-activated modulator for use with a radar system, said radar system having a radar transmitter which emits a carrier radio frequency signal, a dielectric waveguide antenna, which transmits said carrier radio frequency signal, and a metallic waveguide which conducts said carrier radio frequency signal from said radar transmitter to said dielectric waveguide antenna, said light-activated modulator comprising:

an illumination source which emits an optical modulating signal; and a photoconductor layer which is placed adjacent to said dielectric waveguide antenna, and which receives said optical modulating signal from said illuminations source, wherein said photoconductor layer comprises Ge, and wherein said light-activated modulator emits said optical modulating signal with variable intensities such that said optical modulating signal has a wavelength of about $\lambda_c$ where $\lambda_c$ is given by:

$$\lambda_c = \frac{1.24}{E_g} \text{ microns,}$$

where: $E_g$ is an energy gap which is measured in electron volts for Ge and equals about 0.67 electron volts, said optical modulating signal thereby decreasing said photoconductor layer's transparency to said carrier radio frequency signal as said optical modulating signal increase in intensity, said optical modulating signal allowing said photoconductor layer's transparency to increase as said optical modulating signal decreases in intensity, said light-activated modulator thereby optically modulating said carrier radio frequency signal.

6. A light activated modulator for use with a radar system, said radar system having a radar transmitter which emits a carrier radio frequency signal, a dielectric waveguide antenna which transmits said carrier radio frequency signal, and a metallic waveguide which conducts said carrier radio frequency signal from said radar transmitter to said dielectric waveguide antenna, said light-activated modulator comprising:

an illumination source which emits an optical modulating signal; and a photoconductor layer which is paced adjacent to said dielectric waveguide antenna, and which receives said optical modulating signal form said illumination source, wherein said photoconductor layer comprises CdSe, and wherein said light-activated modulator emits said optical modulating signal with variable intensities such that said optical modulating signal has a wavelength of about λc where λc is given by:

$$\lambda_c = \frac{1.24}{E_g} \text{ microns,}$$

where: $E_g$ is an energy gap which is measured in electron volts for CdSe and equals about 1.8 electron volts, said optical modulating signal thereby decreasing said photoconductor layer's transparency to said carrier radio frequency signal as said optical modulating signal increases in intensity, said optical modulating signal allowing said photoconductor layer's transparency to increase as said optical modulating signal decreases in intensity, said light-activated modulator thereby optically modulating said carrier radio frequency signal.

* * * * *